US005203057A

United States Patent [19]

Runnels

[11] Patent Number: 5,203,057

[45] Date of Patent: Apr. 20, 1993

[54] PIGGY BACK JEWELRY CATCH

[76] Inventor: Donna M. Runnels, 1010 S. Veal, P.O. Box 546, Sundown, Tex. 79372

[21] Appl. No.: 847,574

[22] Filed: Mar. 5, 1992

[51] Int. Cl.[5] ..... A44B 17/00

[52] U.S. Cl. ..... 24/573.1; 24/616; 24/625

[58] Field of Search ..... 24/573.1, 573.3, 616, 24/615, 618, 625, 116 A, 597

[56] References Cited

U.S. PATENT DOCUMENTS

| | | | |
|---|---|---|---|
| D. 300,614 | 4/1989 | Geldwerth . | |
| 1,099,484 | 6/1914 | Brassler | 24/616 |
| 2,266,074 | 12/1941 | Rauer | 24/616 |
| 2,539,777 | 1/1951 | Grassmann, Sr. | 24/573.1 |
| 2,650,398 | 9/1953 | Bangs | 24/616 |
| 2,952,058 | 9/1960 | Geldwerth . | |
| 3,299,679 | 1/1967 | Anderson | 24/616 |
| 3,308,517 | 3/1967 | Geldwerth . | |
| 4,559,679 | 12/1985 | Downey | 24/573.1 |
| 4,713,865 | 12/1987 | Geldwerth . | |

FOREIGN PATENT DOCUMENTS

| | | | |
|---|---|---|---|
| 2328370 | 12/1974 | Fed. Rep. of Germany | 24/625 |
| 0793249 | 4/1958 | United Kingdom | 24/573.1 |

OTHER PUBLICATIONS

ABS Artistic Jewelry Inc. One Sheet, no date.
Eugene Birow Corp. U.S., One Sheet, no date.
Neti Company, One Sheet, no date.

*Primary Examiner*—Victor N. Sakran
*Attorney, Agent, or Firm*—Tracy W. Druce

[57] ABSTRACT

Apparatus and method for providing a catch capable of combining two flexible bands into one loopable accessory that may be fastened about a wearer, typically with only one hand. The invention has a catch body that is connected to an end of a guard and a male guard tongue that is attached to an opposite end of the guard. The catch body is constructed so as to have two female receivers. One receiver serves as a receptacle for the male bracelet tongue and is fastenable thereto. The other receiver serves as a mating receptacle for the male guard tongue. The bracelet is fixed in place in a track of the guard. The bracelet is looped about the guard so that the tip of the bracelet tongue passes through the receiver and inserts into the opposite end of the bracelet which is also positioned within the catch. By connecting all ends of the several bands at the catch body, a combination loop is formed.

26 Claims, 3 Drawing Sheets

PIGGY BACK JEWELRY CATCH

CROSS REFERENCE TO RELATED APPLICATION

There are no related applications at this time, however, Applicant filed Disclosure Document No. 293163 on Oct. 15, 1991 which concerns this application. Therefore, by separate paper filed herewith it is respectfully requested that the Disclosure Document be retained and acknowledgment thereof made by the Examiner. (MoPEP 1706)

BACKGROUND OF THE INVENTION

1. Field of the Invention

This invention relates generally to catches used to secure the ends of looped accessories worn by a person. More specifically, the embodiments shown herein relate to jewelry catches used in conjunction with bracelets and guards in which those bracelets are often positioned while being worn. Those having ordinary skill in the art are makers of ornamental accessories worn by a person and the catches thereof.

2. Description of the Related Art

Catches are well known items in the art; especially jewelry catches. The catches on a piece of jewelry is important because it safeguards and prevents the wearer from losing the jewelry while it is being worn. The jewelry being secured by a catch is typically a necklace or bracelet that is looped about a wearer's neck or wrist. Like all loops, necklaces and bracelets are only as strong as the weakest point in the loop. Therefore, the catch of a piece of jewelry must be as strong or stronger than the other segments in the loop.

It is a well known practice in the art to place a styled bracelet within the track of a guard or jacket. The purpose of the guard is to both decoratively accentuate and to protect the more delicate bracelet. The conventional means for fixing the bracelet-guard combination about the wearer's wrist is to install the bracelet into the guard so that the clasping mechanisms of the smaller bracelet protrude through the guard thereby connecting the two bands together. Fastening of the bracelet-guard combination is then accomplished by fastening the catch of the bracelet.

A bracelet placed within a guard is typically delicate. The guard, however, is more substantial because one of its purposes is to create a more noticeable piece of jewelry. Most often the guard has a track into which the bracelet is placed. The weight of the guard is usually greater than that of the bracelet. Therefore, in the bracelet-guard combination the catch designed for the bracelet alone may carry two times or more the weight for which it was designed.

The hazards associated with this type of combination are obvious. The catch for the bracelet alone is not designed to carry the excess weight of the guard and therefore is more likely to malfunction. In the event that the catch does malfunction; the catch may disengage or be broken and the bracelet and guard may be lost.

In one known configuration, the bracelet is connected to the guard by placing each end of the bracelet under loops at the ends of the guard. These loops may cause friction to the bracelet and damage the setting of the stones of the bracelet to such a degree that the stones become loosened and fall from their mountings.

Another known means for accomplishing the desired bracelet-guard combination is to fasten both the guard and the bracelet independently. This is accomplished by first fastening the guard about the wearer thereby forming a loop with said guard. The bracelet is then placed within the track of the guard and fastened thereabout. To assure that the bracelet remains within the track of the guard, the fit of the bracelet about the guard must be snug. In this configuration, pressure is usually exerted by the outer bracelet on the interior guard and causes the links of the guard to bind and prevents the loop from retaining a desired flexibility in the band combination. Further, because of the required snug fit of the bracelet about the guard, it is difficult for a wearer to secure both bracelets about one's self. Typically, a second person will be required to accomplish the looped combination; especially if the loop is to be worn about one's wrist so that only one hand of the wearer is free for accomplishing fixation of the combined bracelet and guard about the wrist. Finally, in this configuration, wear due to abrasion between the guard and bracelet may occur. The result can be breakage of the more delicate bracelet or lost stones if the mountings on the bracelet are damaged.

The following U.S. patents are known to the inventor of the present invention and are associated with jewelry catches. Those patents known to the inventor are:

| | | |
|---|---|---|
| S. Geldwerth | 2,952,058 | 1960 |
| | 3,308,517 | 1967 |
| | 4,713,865 | 1987 |
| | DES.300,614 | 1989. |

GELDWERTH '058 discloses a flexible jewelry band and snap catch that accommodates bracelets or necklaces having various widths. The disclosed catch also has means to prevent looseness or side movement of the catch members during the catching operation. GELDWERTH '517 likewise discloses a catch for jewelry that combines a keeper and a catch in a single stamped blank of sheet metal. The primary purpose of this invention is simplicity of manufacture and inexpensiveness. GELDWERTH '865 discloses a streamlined unobtrusive jewelry catch. The purpose of that invention is to provide an unobtrusive catch that does not detract from the jewelry it fastens as well as provides a built-in safety catch mechanism. GELDWERTH '614, a design patent, shows essentially the same invention as GELDWERTH '865.

Copies of the patent references are enclosed herewith for Examiner's consideration. Color copies of the specific pages of the above referenced catalogs and sales brochure showing bracelets 10 and guards 12 are likewise provided herewith and are expressly incorporated into this disclosure by reference. None of the references, however, are considered to be prior art in that said references do not anticipate nor make obvious the present invention.

SUMMARY OF THE INVENTION

1. Progressive Contribution to the Art

This invention provides a catch that is to be connected to a guard designed with a track along its length for the placement of a narrower bracelet therein. As described above, presently available catches are connected to the bracelet and when the bracelet is installed into the guard, the catch of the bracelet carries the weight of both the bracelet and the guard when worn. This invention provides a catch body into which a male end of the bracelet may be fastened as well as a male end of the guard. Inventor's new catch is designed for the weight of both the guard and the bracelet in combination and has the ability to securely fasten both in combination about the water. It is contemplated, however, that the utility of the present invention is not limited to bracelets worn about the wrist but would also be useful in necklace combinations.

Still further, the design of the present invention is contemplated to be useful in conjunction with any accessories where two bands are to be combined and a single common catch is desired for creating one looped item. Examples of these further applications include hat bands, belts and the like.

By having the catch designed to carry the weight of both the bracelet and the guard in combination, more security is provided to the owner of the jewelry in that the catch is less likely to become disengaged or broken while the jewelry is being worn. By having the weight of the combination carried on this more substantial catch, there is less likelihood of disengagement than when the original catch of the bracelet alone secures both the bracelet and guard.

This invention also provides a locking tongue receiver for the tongue of the bracelet. By having the bracelet tongue receiver matable with the male bracelet tongue of the bracelet, the bracelet is lockable within the guard. Because of the configuration made possible by this invention, there is less likelihood that the bracelet will become loosened and disengaged from the guard in which it is to be secured.

This invention provides means for doubly securing the bracelet within the guard for additional safety. The catch body of the present invention provides a knob and catch knob recess for receiving the safety latch of the bracelet.

The present invention also provides a means for quickly and easily exchanging bracelets within the track of a guard. The wearer of the guard may easily disengage the bracelet initially placed therein and exchange it for another to create a different look and essentially a second accessory. This is highly beneficial to the wearer in that it provides a means by which combinations between different bracelets and guards may be created thereby expanding the wearer's ability to accessorize by allowing various combinations.

The invention also provides a means for making the guard of the combination more decorative. By configuring the catch body like the other links of the guard, the bracelet-guard combination is made to look like a continuous loop. This is accomplished by positioning ornamental tabs upon a lower portion of the catch body. Further toward the goal of camouflaging the catch, an ornament similar to a link of the bracelet is positioned upon the top of the catch body.

A primary benefit of this invention is that it allows the wearer to easily fasten the guard-bracelet combination. Previous methods for combining the bracelet with the guard were unwieldy and difficult to fasten with one hand. By having the single catch of the present invention, a wearer can easily fasten the bracelet and guard about a wrist using the opposite hand.

2. Objects of the Invention

An object of this invention is to provide a catch capable of combining two loopable accessories into one.

Another object of this invention is to provide a jewelry catch that is designed to carry a bracelet and guard combination securely.

Another object of this invention is to create a more attractive piece of jewelry by causing the looped bracelets to appear continuous, without the interruption caused by a conventional catch.

Another object of this invention is to provide a jewelry catch that serves as a means for combining and securing a bracelet within a guard.

Another object of this invention is to provide a catch with means for easily and quickly disengaging and engaging bracelets within a guard so that different bracelets may be interchanged within one guard.

Still a further object of this invention is to provide a catch that may be engaged and disengaged easily.

Further objects are to achieve the above with devices that are sturdy, compact, durable, lightweight, simple, safe, efficient, versatile, and reliable, yet inexpensive and easy to manufacture, install, operate, and maintain.

Still further objects are to achieve the above with a method that is rapid, versatile, efficient, and inexpensive, and does not require highly skilled people to implement.

The specific nature of the invention, as well as other objects, uses, and advantages thereof, will clearly appear from the following description and from the accompanying drawings; the different views of which are not necessarily scale drawings.

Figure 1:
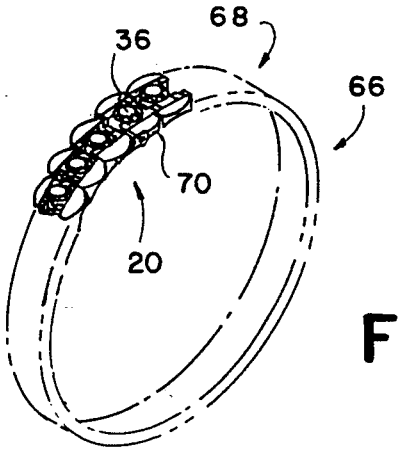
FIG. 1 is a perspective view of the bracelet and guard combination fastened at the catch body thereby forming the combination loop.

As an aid to correlating the terms of the claims to the exemplary drawings, the following catalog of elements and steps are provided:

| | |
|---|---|
| 10 | bracelet |
| 12 | guard |
| 13 | guard track or channel |
| 14 | catch knob recess |
| 20 | catch body |
| 22 | guard-catch connector |
| 24 | female bracelet tongue catch receiver |
| 26 | male guard tongue |
| 28 | catch safety latch knob |
| 30 | bracelet recess |
| 32 | female guard tongue receiver |
| 36 | ornament |
| 38 | guard release button |
| 39 | bracelet release button recess |
| 40 | female bracelet tongue receiver |
| 42 | male bracelet tongue |
| 43 | bracelet release button |
| 44 | safety latch |
| 46 | safety latch hinge |

-continued

| | |
|---|---|
| 48 | bracelet safety latch knob |
| 52 | bracelet tongue lock |
| 53 | guard tongue lock |
| 56 | guard link |
| 58 | bracelet link |
| 60 | stabilizer knob |
| 62 | mounting indicator hole |
| 64 | bracelet safety latch knob recess |
| 66 | combination band |
| 68 | combination loop |
| 70 | ornamental tab |
| 72 | bracelet end |
| 74 | guard end |
| 76 | body top |
| 78 | body bottom |
| 80 | latch side |
| 82 | button side |

DESCRIPTION OF THE PREFERRED EMBODIMENTS:

Structure

The present invention provides catch body 20 capable of securing opposite ends of bracelet 10 and guard 12 thereby forming a combination loop 68 to be worn by a person. The body 20 has a bracelet end 72, a guard end 74, a top 76, a bottom 78, a latch side 80, and a button side 82. The catch body 20 has means for receiving and holding fast male bracelet tongue 42 and male guard tongue 26 when said tongues are positioned within the receivers. The catch 20 makes it possible to combine the bracelet 10 and the guard 12 so that together they form one combination band 66 while also providing means for securing the two ends of said combination band 66.

Figure 3:
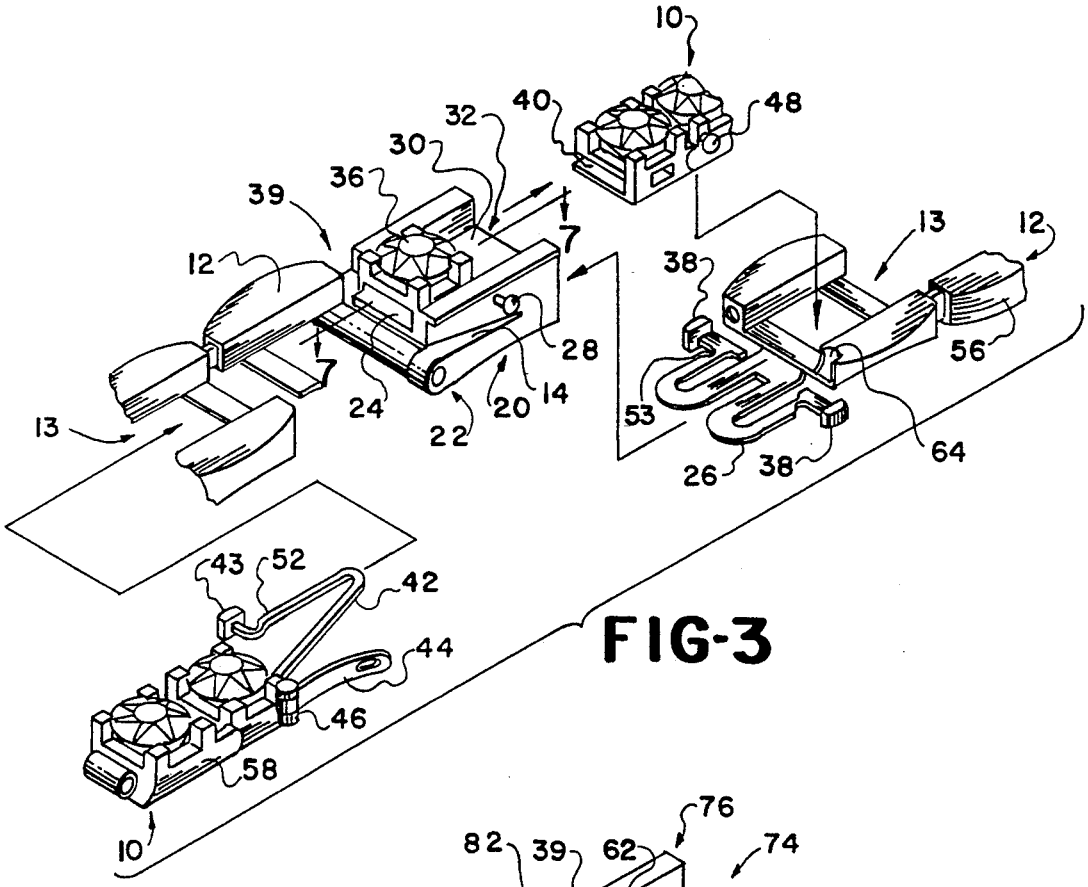
FIG. 3 is an exploded perspective view of the catch connected to a guard and showing the bracelet as it is to be installed into the guard.

As seen in FIG. 3 of the accompanying drawings, the catch body 20 has a guard-catch connector 22 at the bracelet end 72 by which the body 20 is hinged to guard 12. The guard 12 is constructed from individual guard links 56 that are hinged together, end-to-end, so that the guard 12 is a flexible band. Also seen in FIG. 3 is the bracelet 10 that, like the guard 12, is made up of individual bracelet links 58 that are hinged together, end-to-end, so that the bracelet 10 is likewise a flexible band. The guard 12 is typically more substantial than the bracelet 10 and therefore said guard is referred to as the greater band and the bracelet as the lesser band. Each band has a tongue end and the opposite end of the guard 12 is a catch end and the opposite end of the bracelet 10 is a receiver end.

Figure 5:
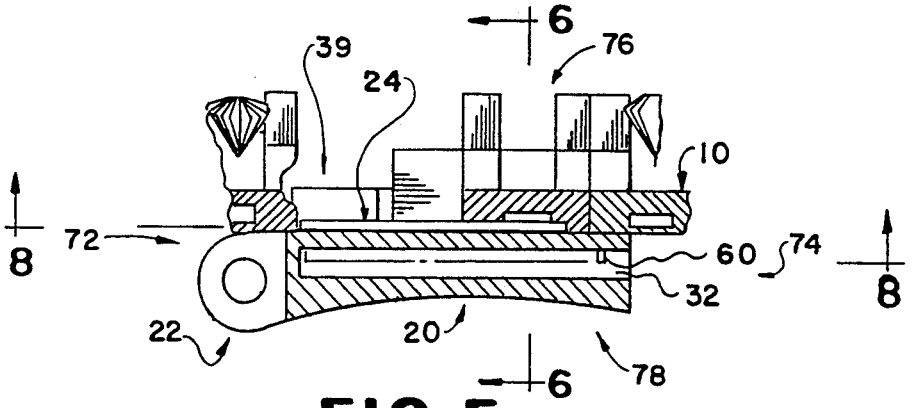
FIG. 5 is a longitudinal cross sectional view along line 5—5, as shown in FIG. 4.

Referring to FIGS. 3 and 5, the female guard tongue receiver 32 is above the female bracelet tongue catch receiver 24. As a result of this one above the other orientation, the length of the catch body is less than the cumulative length of the receivers 32 and 24.

Guard track 13 presents a channel along a top surface of the guard 12 running the length of said guard 12. The track 13 has a width adequate to accommodate the bracelet 10 when said bracelet 10 is positioned within said track 13. The depth of the track 13 may be varied but will typically be such that when the bracelet 10 is placed in the track, an appearance is given that the ornamental stones of said bracelet 10 are mounted upon the guard 12. The guard-catch connector 22 is constructed so that it is possible for the catch body 20 to be pivoted at a right angle to a link of the guard 12 to which said body is connected. This facilitates engagement of the bracelet tongue 42 into a female bracelet tongue catch receiver 24.

The bracelet tongue 42 is connected to the bracelet 10 at the tongue end of said bracelet 10. Near a base of the tongue 42, where said tongue 42 is connected to the bracelet 10, safety latch 44 is connected to the bracelet 10 by safety latch hinge 46. Bracelets 10 of this type are commercially available having tongues 42 and latches 44 similar to that described and shown herein. The tongue 42 has bracelet tongue lock 52 that serves as means for locking the tongue 42 in the catch bracelet tongue receiver 24 within the catch body 20. Located on one side of the bracelet tongue 42 is bracelet release button 43. The button 43 is used to disengage the tongue 42 from the receiver 24. By depressing the button 43, the lock 52 is pushed away from an interior wall of the receiver 24 to which said tongue 42 had been mated by the lock 52.

A female bracelet tongue receiver 40 is located at the receiver end of the bracelet 10 at an opposite end of the bracelet 10 from the tongue 42. The receiver 40 is of conventional design and is well known within the art. As such, the details thereof are not shown. Because the receiver 24 is designed to mate with the bracelet tongue 42 just as the female bracelet receiver 40 of the bracelet 10 is made to mate therewith, the configuration of interiors of the two receivers 40 and 24 are alike with respect to the areas that engage the tongue 42 and the lock 52. Bracelet safety latch knob 48 is positioned upon the bracelet 10 near the receiver end. The knob 48 has a stem and distal bulbous end to be used in conjunction with the safety latch 44 for doubly securing the bracelet 10 when fastened. As seen in FIG. 3, the latch 44 has a hole of adequate size to be placed over the bulbous end of the latch knob 48 near the end of said latch 44 opposite the hinge 46. The fit, however, of the hole over the knob 48 is sufficiently snug to maintain said latch 44 on said knob 48 until purposely disengaged by the wearer.

Catch safety latch knob 28 is provided at the latch side 80 of the catch body 20. The knob 28 is located within a catch knob recess 14 which provides a recession into the catch body 20 for receiving the latch 44 when the bracelet tongue 42 is fastened into the tongue receiver 24 of the catch body 20. The recess 14 in the body 20 is deeper near the bracelet end 72 and shallower near the guard end 74. The knob 28 is located in the shallower portion of the recess 14. Mating of the latch 44 over the catch latch knob 28 is identical to that described above when the ends of the bracelet 10 are fastened together and doubly secured by the safety latch 44.

On the top side 76 of the catch body 20 may be found ornament 36. In the embodiment of FIG. 3, the ornament 36 is shown as a cut stone set in prongs. Also at the top 76 and adjacent to the ornament 36 is bracelet recess 30 near the guard end 74 of the body 20. The width of the bracelet recess 30 is similar to that of the track 13 in the guard 12. That is, the width of the bracelet recess 30 is adequate to accommodate the receiver end of the bracelet 10. When the tongue receiver 40 of the bracelet 10 is properly positioned within the bracelet recess 30, the receiver 40 and the receiver 24 are at like elevations. As such, the tongue 42 may be installed into the receiver 24 and locked into position therein with a tip of said tongue 42 protruding beyond the receiver 24 and resting within an interior of the bracelet tongue receiver 40.

Figure 6:
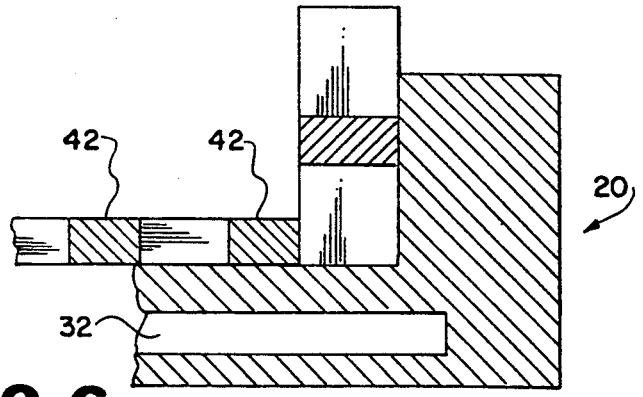
FIG. 6 is a lateral partial sectional view of the catch body along line 6—6, as shown in FIG. 5.
Figure 8:
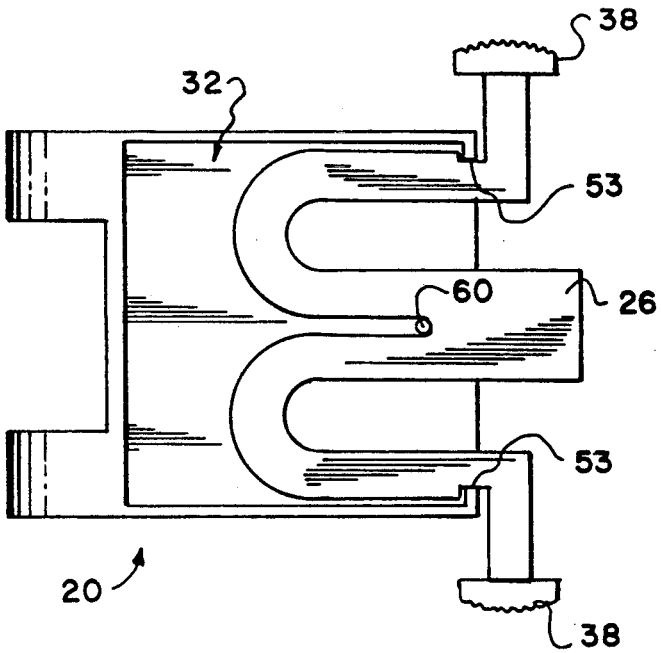
FIG. 8 is a sectional view showing the female guard tongue receiver.
Figure 7:
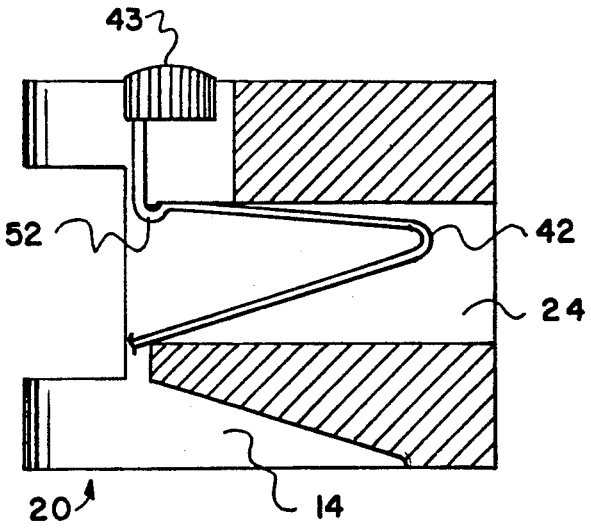
FIG. 7 is a sectional view showing the female bracelet tongue catch receiver.

Referring to FIGS. 5 and 6, female guard receiver 32 may be seen within the body 20. The guard tongue receiver 32 is constructed to accommodate the insertion of the male guard tongue 26 and said tongue's 26 mating thereto. Located along the center of the guard tongue receiver 32 is stabilizer knob 60 that fits between two arched halves of the tongue 26 thereby providing stability when the tongue 26 is locked within the guard tongue receiver 32. The criteria for construction of the receiver 32 is that it be matable with the guard tongue 26.

Referring once again to FIG. 3, the guard tongue 26 is attached to a tongue end of the guard 12. The embodiment of the tongue 26 shown comprises two arches having guard tongue locks 53 at exterior bases of the arches. The configuration of the guard tongue 26 is well known within the art and said tongue 26 is commercially available. Much like the bracelet tongue receiver 24, an interior of the guard tongue receiver 32 is constructed so as to lockably mate with the guard tongue 26 when said tongue 26 is inserted therein. The guard tongue 26 has guard release buttons 38 which are used to unlock and disengage the tongue 26 from the guard tongue receiver 32 by pushing the locks 53 away from the interior walls of the receiver 32.

At the tongue end of the guard 12 is bracelet safety latch knob recess 64. Said knob recess 64 being located in an exterior end of an end link of the guard 12 near the tongue end of said guard 12. The safety latch knob recess 64 is made to receive the safety latch knob 48 of the bracelet 10. The construction of the knob recess 64 is such that when the knob 48 is placed therein, disengagement of said knob 48 from within the knob recess 64 is retarded until said knob 48 is intentionally disengaged by the wearer. More specifically, the interior is a spherically shaped void that is matable with the knob 48. The fit between the knob recess 64 and the knob 48 is sufficiently snug to retard other than intentional disengagement by the wearer.

Figure 2:
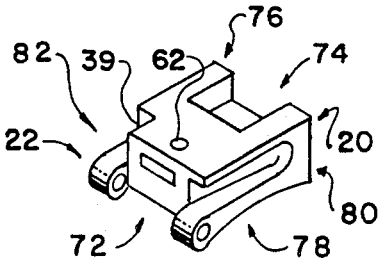
FIG. 2 is a perspective view of an embodiment of the catch body showing a mounting indicator hole.
Figure 4:
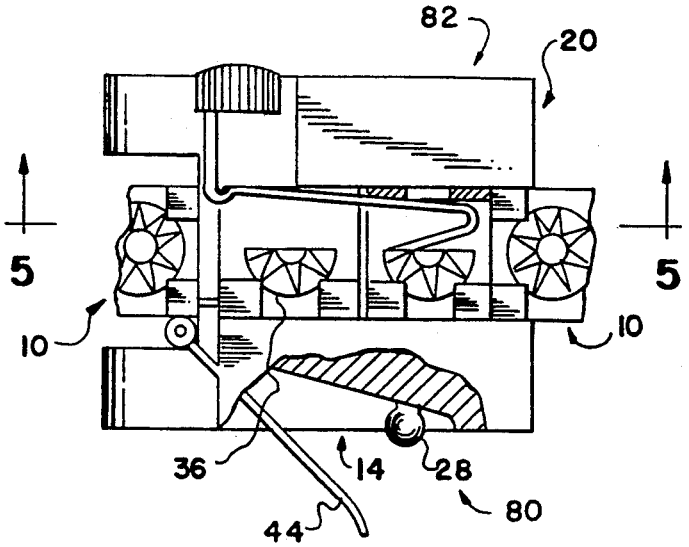
FIG. 4 is a top plan view of a fastened catch with cut-aways showing the safety latch and an installed bracelet.

Referring to FIG. 2, bracelet release button recess 39 may be seen. When the bracelet tongue 42 is locked into the bracelet tongue receiver 24 of the catch body 20, the release button 43 is located within the button recess 39. The button recession 39 allows the tongue button 43 to remain flush within the catch body 20 when the bracelet 10 is connected to said body 20. Also seen in FIG. 2 is mounting indicator hole 62. In the alternative embodiment of FIG. 2, the indicator hole 62 draws the attention of a jeweler to that position and indicates that an ornament 36 may be positioned thereupon.

Alternatively the bracelet recess 30 may be extended to the point where the hole 62 is located to accommodate the mounting of the ornament 36 similar to those used for the links 58 of the bracelet 10 by installing prongs upon the area where the hole 63 had been. By placing the ornament 36 upon the catch body 20 as shown in FIG. 3, the appearance of a continuous bracelet about the guard is presented. That is, by providing a matching ornament upon the catch body 20 the illusion of a continuous loop is accomplished. By positioning ornamental tabs 70 upon the body 20, said body is made to also resemble a link 56 of the guard 12 thereby enhancing the illusion of a continuous combination loop 68.

Method

The method described herein for operating the above described catch 20 assumes that the guard tongue 26 has been fixed to the tongue end of the guard 12 and the catch body 20 has been connected to the catch end of the guard 12 by the guard-catch connector 22.

The bracelet tongue 42 is inserted into the bracelet tongue receiver 24 of the catch body 20. The tongue 42 is inserted until it locks into position and is held fast therein. The locking action is accomplished by having indentions into interior walls of the receivers into which the locks 52 and 53 mate thereby restricting the disengagement of the tongues from the receivers. This may be accomplished by pivoting the catch body 20 about the guard-catch connector 22 so that the catch body 20 is at an angle to the guard link 56 to which said body is connected. This facilitates the insertion of the tongue 42. The body 20 is then pivoted back into a position so that said body 20 is aligned with the guard link 56 to which said body 20 is connected. At the same time, the link 58 of the bracelet 10 to which the tongue 42 is fastened is positioned into the guard track 13.

The bracelet 10 is then positioned within the guard track 13 from the catch body 20, to which the bracelet is now fastened, along the length of the guard 12 until the entire length of the bracelet 10 is placed within said track 13. When the bracelet is positioned completely within the track 13, the bracelet safety latch knob 48 is positioned proximate to the bracelet safety latch knob recess 64 found on an interior end of the last guard link 56 of the guard 12. A slight tension is then placed on the bracelet 10 away from the bracelet tongue 42 so that the safety latch knob 48 may be positioned within the latch knob recess 64. The latch knob 48 is then pushed back into the knob recess 64 where it is secured by the snug fit between the knob 48 and the interior of the recess 64.

At this point, the bracelet 10 and the guard 12 have been combined into the flexible combination band 66 that may now be fastened about the wearer. Fastening of the bracelet-guard combination band 66 is then accomplished by inserting the guard tongue 26 into the guard tongue receiver 32 of the body 20 until said tongue 26 is locked into position therein. Having done so, a continuous loop 68 has then been formed from the bracelet-guard combination band 66.

To disengage the band from about the wearer, the guard tongue buttons 38 are depressed so that the tongue 26 is pushed away from interior walls of the receiver 32 and the guard tongue locks 53 are disengaged. Said tongue 26 may then be pulled from the guard tongue receiver 32. Tension is then applied to the bracelet thereby disengaging the safety latch knob 48 from the latch knob recess 64. Finally, the bracelet tongue button 43 may be depressed to disengage the bracelet tongue lock 52 and allow the tongue 42 to be withdrawn from the bracelet tongue receiver 24 and the bracelet and guard thereby separated. To facilitate the disengagement of the tongue 42, the catch body 20 may be pivoted at the connector 22 first.

Alternatively, the tongue 42 may be disengaged first and then the knob 48.

The embodiments shown and described above are only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim:

1. Structure for combining at least two ornamental bands into a combination loop comprising:

a. a catch body;

b. the catch body having a bracelet end, a guard end, a top, a bottom, a latch side and a button side;

c. a female guard tongue receiver located at the guard end and within said body;

d. a female bracelet tongue catch receiver located at the bracelet end and within said body;

e. each tongue receiver within said body being matable to a male tongue;

f. a guard-catch connector at the bracelet end of said body for attaching the body to a band;

g. a catch knob recess in the body on the latch side of the body;

h. the recess being deeper near the bracelet end and shallower near the guard end;

j. a catch knob located in the recess at the shallower portion of said recess; and k. said catch knob being matable with a safety latch.

2. The invention as recited in claim 1, further comprising:

l. a bracelet release button recess in the button side of the body and at the bracelet end of said body.

3. The invention as recited in claim 2, further comprising:

m. a bracelet recess in the top of the body and at the guard end of said body.

4. Structure for combining at least two ornamental bands into a combination loop comprising:

a. a catch body;

b. the catch body having a bracelet end, a guard end, a top, a bottom, a latch side and a button side;

c. a female guard tongue receiver located at the guard end and within said body;

d. a female bracelet tongue catch receiver located at the bracelet end and within said body;

e. each tongue receiver within said body being matable to a male tongue;

f. a guard-catch connector at the bracelet end of said body for attaching the body to a band;

g. a greater band having a catch end connected to the body by the guard-catch connector and a tongue end;

h. at least one lesser band having a tongue end connectable to the body and a receiver end connectable to the greater band;

j. a male tongue connected to the tongue end of the greater band;

k. a male tongue connected to the tongue end of the lesser band;

l. a female tongue receiver at the receiver end of the lesser band;

m. the male tongue of the greater band being matable to the female guard tongue receiver in the body;

n. the male tongue of the lesser band being matable to the bracelet tongue catch receiver;

o. the greater band is a guard;

p. the guard comprising guard links connected end-to-end thereby forming a flexible band;

q. the lesser band is a bracelet;

r. the bracelet comprising bracelet links connected end-to-end thereby forming a flexible band;

s. the guard having a track along said guard's length into which the bracelet may be placed;

t. the female bracelet tongue receiver being located in an end link at the receiver end of the bracelet;

u. the bracelet recess of the body capable of receiving the end link of the bracelet;

v. the female bracelet tongue receiver being aligned with the bracelet tongue catch receiver when the end link is installed into the bracelet recess;

w. a bracelet safety latch knob attached near the receiver end of the bracelet; and x. a bracelet safety latch knob recess located in an exterior end of an end link of the guard at the tongue end of the guard.

5. The invention as recited in claim 4, further comprising:

y. ornamental tabs positioned upon the catch body so that said body resembles a link of the guard.

6. The invention as recited in claim 5, further comprising:

z. an ornament positioned upon the top of the body; and aa. said ornament constructed so that it resembles a link of the bracelet.

7. The invention as recited in claim 6, further comprising:

bb. the bracelet tongue installed into and mated with the bracelet tongue catch receiver so that said bracelet tongue is locked into said receiver;

cc. the bracelet is positioned into the track of the guard;

dd. the bracelet safety latch knob secured into the bracelet safety latch knob recess at the end link of the guard so that the bracelet is mated to the guard thereby forming a combination band comprising the bracelet and the guard;

ee. the male guard tongue installed into and mated with the female guard tongue receiver so that said guard tongue is locked into said receiver; and ff. a tip of the bracelet tongue projecting into the bracelet tongue receiver thereby forming gg. a combination loop by connecting the ends of the bracelet and the ends of the guard at the primary catch body so that said combination loop resembles a continuous loop.

8. The invention as recited in claim 7, further comprising:

hh. a catch knob recess in the body on the latch side of the body;

jj. the recess being deeper near the bracelet end and shallower near the guard end;

kk. a catch knob located in the recess at the shallower portion of said recess;

ll. said catch knob being matable with a safety latch;

mm. a bracelet release button recess in the button side of the body and at the bracelet end of said body; and nn. a bracelet recess in the top of the body and at the guard end of said body.

9. Method for combining at least two ornamental bands into a combination loop comprising the following steps:

a. providing a catch body capable of joining each of two ends of a guard and each of two ends of a bracelet at said catch body;

b. attaching one end of the guard to the body;

c. connecting the bracelet to the body and the guard by d. installing a bracelet tongue located at one end of the bracelet into a bracelet tongue catch receiver in the body;
e. positioning the bracelet into a track that extends the length of the guard;
f. connecting a receiver end of the bracelet to an end of the guard that is opposite the end of said guard connected to the body thereby
g. creating a combination band comprising the bracelet and the guard;
h. installing a guard tongue located at a tongue end of the guard into a guard tongue receiver within the body thereby
j. creating a combination loop comprising the catch body, the bracelet, and the guard;
k. securing a safety latch between the bracelet and the catch body by
l. pivoting said latch about a safety latch hinge by which said latch is connected to the bracelet; and
m. placing said safety latch over a catch latch knob located on the body.

10. The invention as recited in claim 9, further comprising:
n. providing ornamental tabs on the body thereby
o. causing the body to resemble a link of the guard; and
p. positioning an ornament upon a top of the guard thereby
q. causing an upper portion of the body to resemble a link of the bracelet so that when the combination loop is formed the body resembles the bracelet and guard thereby
r. causing the loop to appear continuous.

11. Structure for combining at least two ornamental bands into a combination loop comprising:
a. a catch body;
b. the catch body having a bracelet end, a guard end, a top, a bottom, a latch side and a button side;
c. a female guard tongue receiver located at the guard end and within said body;
d. a female bracelet tongue catch receiver located at the bracelet end and within said body;
e. said female guard tongue receiver and said female bracelet tongue catch receiver being one above the other; and
f. each tongue receiver within said body being matable to a male tongue.

12. The invention as recited in claim 11, further comprising:
g. ornamental tabs positioned upon the catch body so that said body resembles a link of the guard.

13. The invention as recited in claim 11, further comprising:
g. an ornament positioned upon the top of the body; and
h. said ornament constructed so that it resembles a link of the bracelet.

14. The invention as recited in claim 13, further comprising:
j. ornamental tabs positioned upon the catch body so that said body resembles a link of the guard.

15. The invention as recited in claim 11, further comprising:
g. a length of the catch body is less than the cumulative length of the two receivers.

16. The invention as recited in claim 15, further comprising:
h. ornamental tabs positioned upon the catch body so that said body resembles a link of the guard.

17. The invention as recited in claim 16, further comprising:
j. an ornament positioned upon the top of the body; and
k. said ornament constructed so that it resembles a link of the bracelet.

18. The invention as recited in claim 17, further comprising:
l. a guard-catch connector at the bracelet end of said body for attaching the body to a band.

19. The invention as recited in claim 18, further comprising:
m. a greater band having a catch end connected to the body by the guard-catch connector and a tongue end; and
n. at least one lesser band having a tongue end connectable to the body and a receiver end connectable to the greater band.

20. The invention as recited in claim 19, further comprising:
o. a male tongue connected to the tongue end of the greater band;
p. a male tongue connected to the tongue end of the lesser band;
q. a female tongue receiver at the receiver end of the lesser band;
r. the male tongue of the greater band being matable to the female guard tongue receiver in the body; and
s. the male tongue of the lesser band being matable to the bracelet tongue catch receiver.

21. The invention as recited in claim 20, wherein comprising:
t. the greater band is a guard;
u. the guard comprising guard links connected end-to-end thereby forming a flexible band;
v. the lesser band is a bracelet;
w. the bracelet comprising bracelet links connected end-to-end thereby forming a flexible band; and
x. the guard having a track along said guard's length and said track having a width adequate to accommodate the bracelet therein.

22. The invention as recited in claim 21, further comprising:
y. the female bracelet tongue receiver being located in an end link at the receiver end of the bracelet;
z. the bracelet recess of the body capable of receiving the end link of the bracelet; and
aa. the female bracelet tongue receiver being aligned with the bracelet tongue catch receiver when the end link is installed into the bracelet recess.

23. Structure for combining at least two ornamental bands into a combination loop comprising:
a. a catch body;
b. the catch body having a bracelet end, a guard end, a top, a bottom, a latch side and a button side;
c. a female guard tongue receiver located at the guard end and within said body;
d. a female bracelet tongue catch receiver located at the bracelet end and within said body;
e. each tongue receiver within said body being matable to a male tongue; and
f. ornamental tabs positioned upon the catch body so that said body resembles a link of the guard.

24. The invention as recited in claim 23, further comprising:

g. an ornament positioned upon the top of the body; and h. said ornament constructed so that it resembles a link of the bracelet.

25. Method for combining at least two ornamental bands into a combination loop comprising the following steps:

a. providing a catch body having two female tongue receivers in said body and one of said receivers being above the other of said receivers;

b. having at least two bands, one band being a guard and at least one band being a bracelet;

c. attaching male tongues to one end of each band;

d. connecting all ends of the bands at the body by e. attaching one end of the guard to the body and f. fixing an end of the bracelet opposite a tongue end of said bracelet at a tongue end of the guard; and g. mating the tongues on the bands to the female tongue receivers so that said tongues mate with the body thereby h. forming a loop from the bands.

26. The invention as recited in claim 25, further comprising:

j. providing ornamental tabs on the body thereby k. causing the body to resemble a link of the guard; and l. positioning an ornament upon a top of the guard thereby m. causing an upper portion of the body to resemble a link of the bracelet so that when the combination loop is formed the body resembles the bracelet and guard thereby n. causing the loop to appear continuous.

* * * * *